US010208928B1

(12) United States Patent
Aubrey

(10) Patent No.: US 10,208,928 B1
(45) Date of Patent: Feb. 19, 2019

(54) SEAMLESS BACK-LOADED MODULAR LED ASSEMBLY WITH STACKING INTERCHANGEABLE LENSES AND OPTICS

(71) Applicant: Michael B. Aubrey, Azusa, CA (US)

(72) Inventor: Michael B. Aubrey, Azusa, CA (US)

( * ) Notice: Subject to any disclaimer, the term of this patent is extended or adjusted under 35 U.S.C. 154(b) by 0 days.

(21) Appl. No.: 15/670,269

(22) Filed: Aug. 7, 2017

(51) Int. Cl.

| | |
|---|---|
| ***F21V 23/00*** | (2015.01) |
| ***F21V 17/00*** | (2006.01) |
| ***F21V 5/00*** | (2018.01) |
| ***F21V 9/00*** | (2018.01) |
| ***F21V 29/74*** | (2015.01) |
| ***F21V 17/12*** | (2006.01) |
| ***F21V 14/02*** | (2006.01) |
| *F21Y 115/10* | (2016.01) |

(52) U.S. Cl.
CPC ..... *F21V 17/002* (2013.01); *F21V 5/008* (2013.01); *F21V 9/00* (2013.01); *F21V 14/02* (2013.01); *F21V 17/12* (2013.01); *F21V 23/001* (2013.01); *F21V 29/74* (2015.01); *F21Y 2115/10* (2016.08)

(58) Field of Classification Search
CPC . F21V 23/00; F21V 29/00; F21S 6/00; B60Q 1/00
USPC ..... 362/295, 257, 264, 547
See application file for complete search history.

(56) References Cited

U.S. PATENT DOCUMENTS

| | | | | |
|---|---|---|---|---|
| 6,679,647 | B2 * | 1/2004 | Hixon | H02G 3/0616 362/147 |
| 8,534,867 | B1 * | 9/2013 | Beadle | F21V 17/002 362/153.1 |
| 2010/0188856 | A1 * | 7/2010 | Ford | G02B 17/002 362/299 |
| 2010/0254149 | A1 * | 10/2010 | Gill | A61C 19/004 362/373 |
| 2013/0039050 | A1 * | 2/2013 | Dau | G02B 6/0045 362/218 |
| 2015/0092417 | A1 * | 4/2015 | Hoog | F21S 8/026 362/277 |

* cited by examiner

*Primary Examiner* — Edwyn Labaze
(74) *Attorney, Agent, or Firm* — Dunlap Bennett & Ludwig PLLC

(57) ABSTRACT

A seamless back-loaded modular LED assembly is provided for stacking interchangeable lenses and optics that optimizes thermal management of the LED light source. A sleeve seamlessly secures to a back plate that sandwiches the interchangeable lenses and optics in a stacked arrangement within the sleeve, while the back plate provides a nipple for operatively associating with swivel implements so as to enable 270 degrees of rotational pivoting when directing the LED light source.

11 Claims, 4 Drawing Sheets

SEAMLESS BACK-LOADED MODULAR LED ASSEMBLY WITH STACKING INTERCHANGEABLE LENSES AND OPTICS

BACKGROUND OF THE INVENTION

The present invention relates to light fixtures and, more particularly, to a seamless back-loaded modular LED assembly for stacking interchangeable lenses and optics.

Current light fixtures are large and bulky, and made in a way that makes it difficult to access and/or change lenses (before or during the fixture being placed into service), especially without twisting up the wire, especially if they utilize a separate accessory holder. Specifically, today's LED fixtures that accept interchangeable optics and/or accessories are typically, at least in part, front loaded and held in place with a magnet, retainer ring or some other removable device: creating visible, aesthetically undesirable seams along the exterior of the assembly's fixture housing. Furthermore, current interchangeable LED fixtures do no provide a robust mechanical attachment and so the accessories and/or optics can be mistakenly removed or fall out. Moreover, such interchangeable LED fixtures are also limited in the way that they can be accessorized and customized, including the intensity, shape, and color of the light emitted through the optics, and filters. And some current LED fixtures have plates that attach to the sides of the lamp, limiting the rotation to aim the beam.

Another disadvantage of current LED fixtures is that the bulky heat sinks add mass and bulk to the light yet still lack the thermal transfer to efficiently cool the light when higher wattages are required. This is because current LED fixtures with modular components, such as a removable or non-removable fixture housing around the LED heat sink, do not enable 100% surface contact to the entire outer surface of the heat sink. Such an assemblage creates an adverse thermal environment, causing such LED fixtures to run hot due to poor thermal transfer, thereby shortening service life of the LED.

To recap, current LED light fixture assemblies have at least one of the following disadvantages: visible seams; large/bulky; run hot due to poor thermal transfer resulting in a shorter lifespan for the fixture; are limited in the way they can be accessorized; are difficult to access internal elements; and are limited in their adjustability/rotation.

As can be seen, there is a need for a seamless back-loaded modular LED assembly enabling stacking interchangeable lenses and optics that overcomes all of the above-mentioned disadvantages.

SUMMARY OF THE INVENTION

In one aspect of the present invention, a seamless back-loaded modular LED assembly enabling stacking interchangeable lenses and optics includes a thermally conductive sleeve providing an inner circumference defining an internal compartment as the sleeve extends from a front end to a back end; a heat sink defined by an outer circumference having a diameter approximately equal to that of the inner circumference as the heat sink extends from a front sink end to a back sink end; a back plate having a connecting portion with a plate circumference approximately defined by the diameter, wherein the connecting portion secures to the back end in a seamless engagement; a plate nipple extending from the back plate in a direction opposite than that the connecting portion extends; and a through hole formed through the plate nipple.

In another aspect of the present invention, the seamless back-loaded modular LED assembly enabling stacking interchangeable lenses and optics includes a thermally conductive sleeve providing an inner circumference defining an internal compartment as the sleeve extends from a front end to a back end; a shoulder stop provided along the inner circumference inward of the front end; a heat sink defined by an outer circumference having a diameter approximately equal to that of the inner circumference as the heat sink extends from a front sink end to a back sink end; a back plate having a threaded portion with a plate circumference approximately defined by the diameter; a plurality of spaced apart sink slot longitudinally extending along the outer circumference; sleeve threading provided along the inner circumference inward of the rear end, wherein the threading portion securely mates with the sleeve threading into a seamless engagement when rotating the back plate relative to the sleeve; a plate nipple extending from the back plate in a direction opposite than that the connecting portion extends; and a through hole formed through the plate nipple.

These and other features, aspects and advantages of the present invention will become better understood with reference to the following drawings, description and claims.

DETAILED DESCRIPTION OF THE INVENTION

Figure 1:
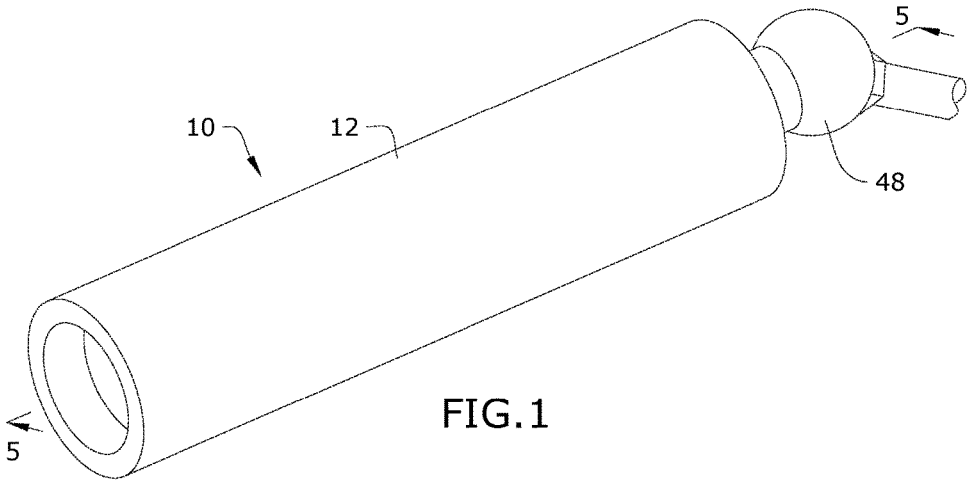
FIG. 1 is a perspective view of an exemplary embodiment of the present invention.
Figure 2:
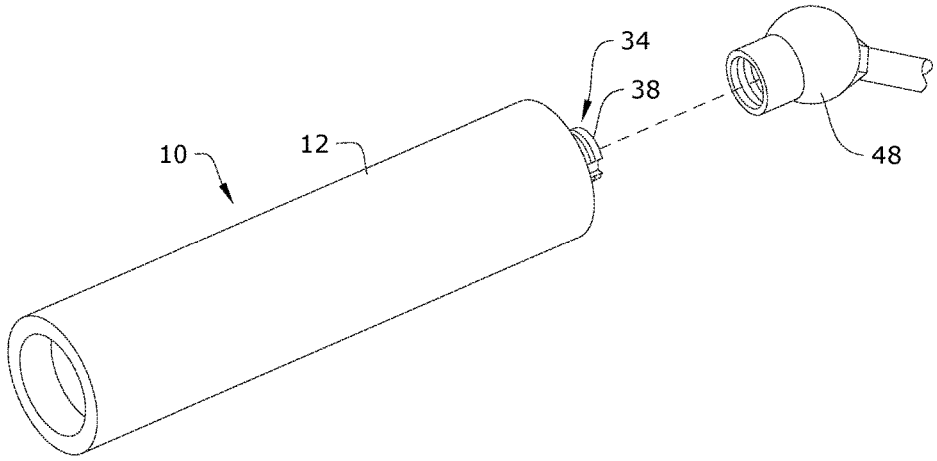
FIG. 2 is an exploded view of an exemplary embodiment of the present invention.
Figure 3:
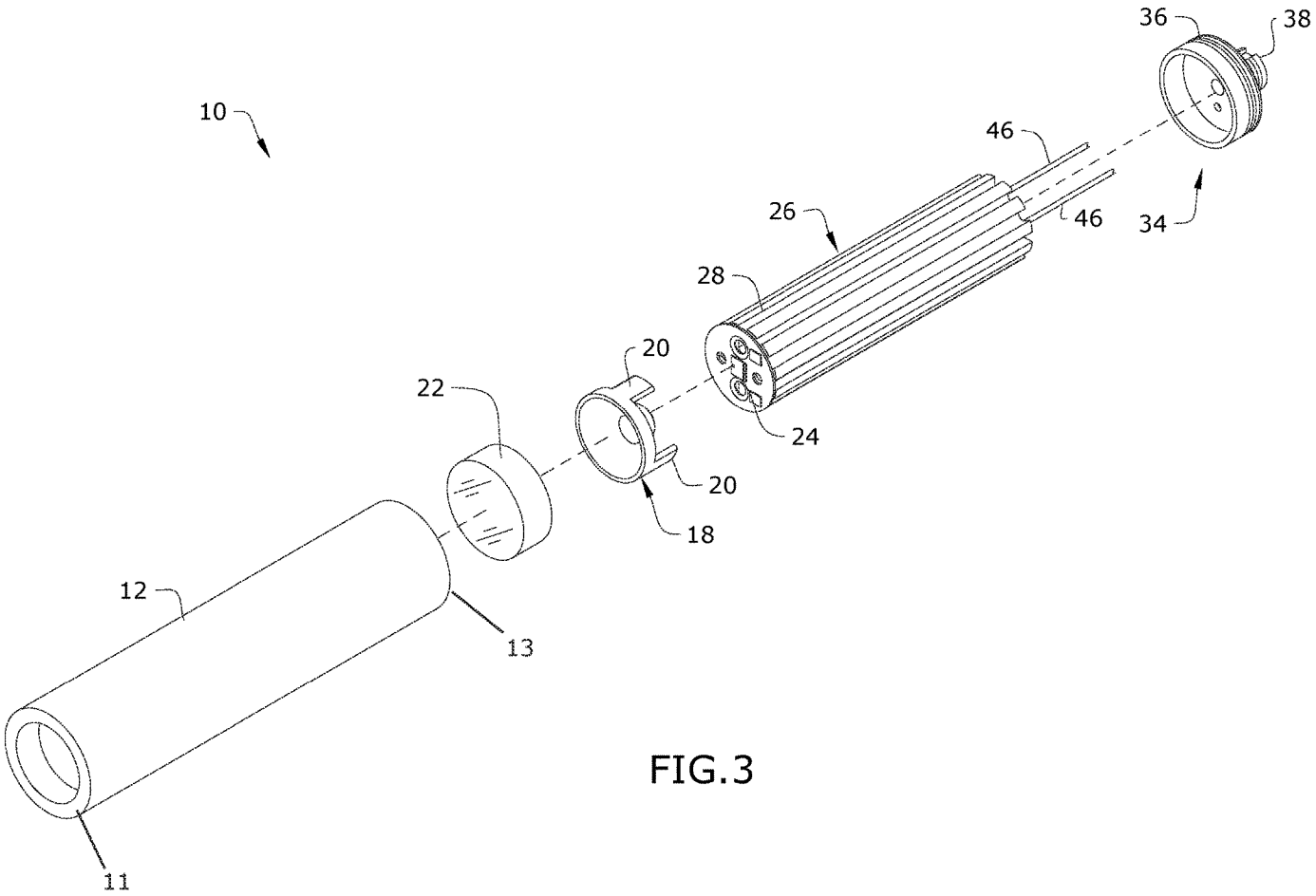
FIG. 3 is an exploded view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a seamless back-loaded modular LED assembly for stacking interchangeable lenses and optics that optimizes thermal management of the LED light source. A sleeve seamlessly secures to a back plate that sandwiches the interchangeable lenses and optics in a stacked arrangement within the sleeve, while the back plate provides a nipple for operatively associating with swivel implements so as to enable 270 degrees of rotational pivoting when directing the LED light source.

Referring to FIGS. 1 through 6, the present invention may include a lamp assembly 10. The lamp assembly 10 may include a sleeve 12 extending from a front end 11 to a back end 13. The sleeve 12 may be an aluminum cylinder, or any other material and shape that enables functionality in accordance with the present invention as described herein. Sleeve threading 14 may be provided along an inner circumference 52 of the back end 13, while a shoulder stop 16 may be provided along the inner circumference 52 of the front end 11.

The following are dimensioned and adapted to slide into an internal compartment defined by the sleeve 12: a filter 22, a lens 18 with or without legs 20, a LED board 24, a heat sink 26 and a threaded portion 36 of a back plate 34.

The threaded portion 36 may be dimensioned and adapted to extend a predetermined length into the internal compartment so as to mate with the sleeve threading 14 through a predetermined length in a mated condition. The threaded portion 36 defines the outer circumference of the back plate 34 so that in the mated condition the back plate 34 and the back end 13 are in a seamless engagement. The back plate 34 seamless engagement design provides a seamless profile with no visible seams to the exterior housing of the lamp assembly 10.

The back plate 34 may provide a plate nipple 38 extending from the back plate 34 in the opposite direction of the threaded portion 36. Protrusion threading 40 may be provided along the outer circumference of the plate nipple 38. The unitized threaded nipple 38 is dimensioned and adapted to operatively associate with any standard swiveling implement 48, track, surface mount, and recessed applications. The plate nipple 38 integrated with the back plate 34 engagement improves any standard swivel element's degree of aim, allowing for 270-degrees rotation in aiming and pointing the lamp's light source/beam depending upon the swivel implement 48 attached.

Figure 4:
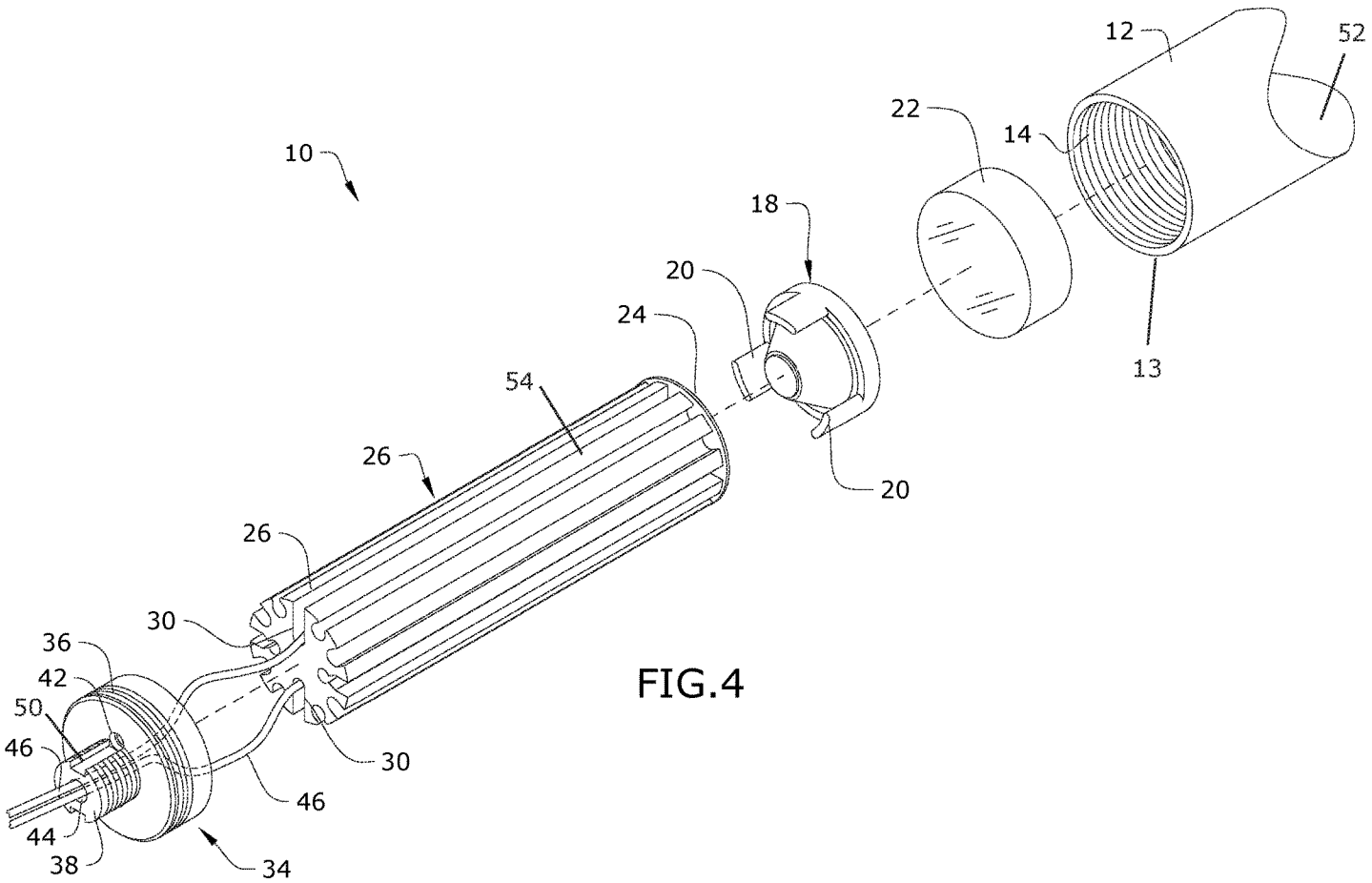
FIG. 4 is an exploded view of an exemplary embodiment of the present invention.
Figure 5:
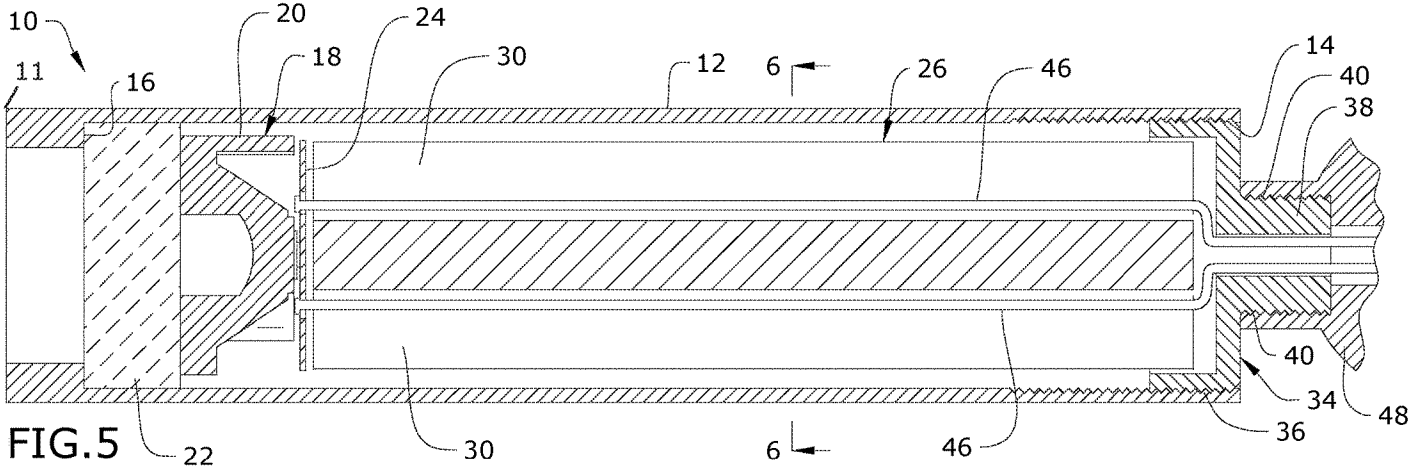
FIG. 5 is a section view of an exemplary embodiment of the present invention, taken along line 5-5 of FIG. 1.
Figure 6:
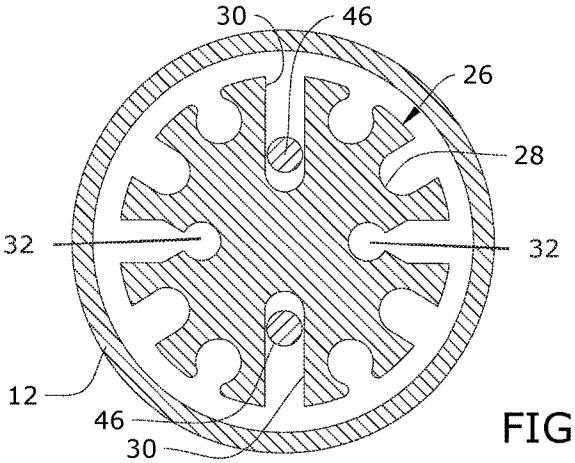
FIG. 6 is a section view of an exemplary embodiment of the present invention, taken along line 6-6 of FIG. 5.

The back plate 34 may provide a through hole 44 extending through the plate nipple 38 so as to communicate within and without of the internal compartment during the seamless engagement, allowing electrical wiring 46 channeled therethrough. Thereby facilitating easy access when removing housed components through the back plate 34, while obviating wire 46 twisting, and likewise enabling a stackable arrangement of interchangeable accessories. The back plate 34 may also provide plate fastener holes 42 for attaching to the heat sink 26. Each plate fastener hole 42 may align, in part, with an associated nipple groove 50 defined by the protrusion threading 40, as illustrated in FIG. 4.

The heat sink 26 may be dimensioned and adapted to snugly engage the inner circumference 52 of the sleeve 12. The heat sink 26 may extend for a length that sandwiches the lens 18, the filter 22 and the LED board 24 between the shoulder stop 16 along the front end 11, while allowing the opposing end of the heat sink 26 to attach to the back plate 34 along the back end 13. The heat sink 26 may provide sink fastener bosses 32 that align with the plate fastener holes 42 for attachment purposes. The heat sink 26 may provide wire slots 30 for the wiring 46 to slide between the through hole 44 to the LED board 24 mounted to a front portion of the heat sink 26. By attaching the back plate 46 to the heat sink 26 with the LED board 24 mounted thereto, the exterior housing/sleeve 12 can be separated from the optic and accessories as simply as removing a light bulb, while not having the electrical wiring 46 that powers the LED twist or pull out. Thereby, the present invention provides flexibility in changing of the accessories and/or optic during or after installation of the light fixture to quickly and easily change the shape, intensity, color and the effects of the light created from the LED, with no tools required. The interior front housing shoulder stop 16 creates the integrated holder that allows optical accessories and internalized components to modularly be loaded into the housing chamber from the back end 13.

The heat sink 26 may provide spaced apart longitudinal dissipation slots 28 extending along its length so that the outer circumference 54 of the heat sink 26 (defining the dissipation slots 28) comes into 100% surface contact with said inner circumference 52. The separate housing chamber/sleeve 12 provides a larger surface area to transfer heat quickly from the internal heat sink it has 100% contact with. The combination of the modular stackable condition and a heat sink 26 that slides into the sleeve 12 to maximize heat sink-sleeve interface improves thermal management of the LED light source, transferring heat away from the LED board 24. This extends its service life and enables a reduction in size though being powered at higher wattages, creating more light from a smaller fixture, as compared to others. As stated above, the modular stackable condition also facilitates design flexibility when changing the intensity, shape and/or color of light of the LED lighting fixture before or after the fixture is placed into service.

A method of using the present invention may include the following. The lamp assembly 10 disclosed above may be provided. A user may manipulate the unitized outer housing/sleeve 12 to slide over or insert the optics, accessories, the LED-mounted heat sink 16 and other interchangeable parts, wherein any electrical wiring 46 of the LED board 24 is guided by the slots/bosses 30 to and out of the through hole 44. Then the user can secure the threaded portion 36 to the back plate 34 to the sleeve 12, tightening down so as to remove all space and internally creating the proper placement of LED/optic/accessories for maximum light, while creating the highest thermal transfer of heat and lamp rotation.

The backplate nipple 38 can operatively associated the present invention to multiple LED fixture adaptations which includes swivel implements 48, recessed, surface mounted or track fixtures, and the like.

Additionally, the present invention can be used as a housing for other electronic items that would benefit from modularity, low temperatures, angle adjustability, and an aesthetically pleasing seamless design; for example, a security camera, flashlights, and the like.

It should be understood, of course, that the foregoing relates to exemplary embodiments of the invention and that modifications may be made without departing from the spirit and scope of the invention as set forth in the following claims.

What is claimed is:

1. An electronics assembly, comprising:

a thermally conductive sleeve providing an inner circumference defining an internal compartment as the sleeve extends from a front end to a back end;

a heat sink defined by an outer circumference having a diameter approximately equal to that of the inner circumference as the heat sink extends from a front sink end to a back sink end;

the heat sink being entirely enclosed in the internal compartment;

a back plate having a connecting portion with a plate circumference approximately defined by the diameter, wherein the connecting portion secures to the back end in a seamless engagement;

a plate nipple extending from the back plate in a direction opposite than that the connecting portion extends; and a through hole formed through the plate nipple.

2. The electronics assembly of claim 1, further comprising:

sleeve threading provided along the inner circumference inward of the rear end; and protrusion threading provided along the plate circumference, wherein the sleeve threading and protrusion threading securely mate in the seamless engagement when rotating the back plate relative to the sleeve.

3. The electronics assembly of claim 1, further comprising:

a shoulder stop provided along the inner circumference inward of the front end.

4. The electronics assembly of claim 1, further comprising:

a plurality of spaced apart sink slot longitudinally extending along the outer circumference.

5. The electronics assembly of claim 1, further comprising:

at least one sink fastener hole provided on the sink back end; and at least one plate fastener hole provided on the back plate, wherein each sink fastener hole aligns with each associated plate fastener hole.

6. The electronics assembly of claim 1, further comprising:

nipple threading provided along a nipple circumference of the plate nipple.

7. The electronics assembly of claim 1, further comprising:

a LED board mounted to the front sink end.

8. The electronics assembly of claim 7, further comprising:

a lens in a stacked arrangement sandwiching the LED board to the heat sink when the back plate is in the seamless engagement.

9. The electronics assembly of claim 8, further comprising:

a filter sandwiched between the lens and the front end when the back plate is in the seamless engagement.

10. An electronics assembly, comprising:

a thermally conductive sleeve providing an inner circumference defining an internal compartment as the sleeve extends from a front end to a back end;

a shoulder stop provided along the inner circumference inward of the front end;

a heat sink defined by an outer circumference having a diameter approximately equal to that of the inner circumference as the heat sink extends from a front sink end to a back sink end;

the heat sink being entirely enclosed in the internal compartment;

a back plate having a threaded portion with a plate circumference approximately defined by the diameter;

a plurality of spaced apart sink slot longitudinally extending along the outer circumference;

sleeve threading provided along the inner circumference inward of the rear end, wherein the sleeve threading securely mates with the threaded portion into a seamless engagement when rotating the back plate relative to the sleeve;

a plate nipple extending from the back plate in a direction opposite than that the connecting portion extends; and a through hole formed through the plate nipple.

11. The electronics assembly of claim 10, further comprising:

a LED board mounted to the front sink end; and a lens in a stacked arrangement, wherein the lens is sandwiching the LED board to the heat sink when the back plate is in the seamless engagement, and wherein the lens is sandwiched against the shoulder stop.

* * * * *